US005514057A

United States Patent [19]

Ciolino

[11] Patent Number: 5,514,057

[45] **Date of Patent: * May 7, 1996**

[54] BATHTUB EXERCISE PLATFORM AND EXCERCISE METHOD

[76] Inventor: Peter A. Ciolino, 92 North Rd., Kinnelon, N.J. 07405

[ * ] Notice: The portion of the term of this patent subsequent to May 30, 2010, has been disclaimed.

[21] Appl. No.: 245,455

[22] Filed: May 18, 1994

Related U.S. Application Data

[63] Continuation-in-part of Ser. No. 894,181, Jun. 5, 1992, Pat. No. 5,314,395.

[51] Int. Cl.[6] ..... A63B 21/008

[52] U.S. Cl. ..... 482/111; 482/142; 5/481; 441/129; D21/237; 4/579

[58] Field of Search ..... 482/55, 111, 124, 482/142, 129; 5/481, 653, 922; 4/573.1, 575.1, 578.1, 579; 434/254; 441/35, 60, 127, 129, 131; 601/23; D21/237

[56] References Cited

U.S. PATENT DOCUMENTS

| | | | |
|---|---|---|---|
| 1,587,605 | 6/1926 | Scroggins . | |
| 2,582,439 | 1/1952 | Kavanagh | 5/579 X |
| 2,623,574 | 12/1952 | Damsch . | |
| 2,803,839 | 8/1957 | Mosley . | |
| 3,167,794 | 2/1965 | Brown . | |
| 3,835,483 | 9/1974 | Emay et al. | 4/579 |
| 3,860,976 | 1/1975 | Suyama . | |
| 4,037,591 | 7/1977 | Sarno | 4/573.1 X |
| 4,394,783 | 7/1983 | Simmons . | |
| 4,687,452 | 8/1987 | Hull . | |
| 4,771,722 | 9/1988 | Tihany . | |
| 4,858,913 | 8/1989 | Stuart . | |
| 5,020,168 | 6/1991 | Wood | 4/573.1 |
| 5,090,695 | 2/1992 | Ciolino . | |
| 5,149,314 | 9/1992 | Ciolino et al. . | |

FOREIGN PATENT DOCUMENTS

| | | | |
|---|---|---|---|
| 358494 | 2/1906 | France | 482/124 |

*Primary Examiner*—Joe H. Cheng

*Attorney, Agent, or Firm*—Hopgood, Calimafde, Kalil & Judlowe

[57] ABSTRACT

Disclosed is a flotation platform engineered to permit aquatic based exercise routines in a conventional bathtub for fitness or rehabilitation, and an exercise method directed to total body strength with focus on stomach and back muscles without undue stress to the lower back, joints and disks of the user.

15 Claims, 5 Drawing Sheets

BATHTUB EXERCISE PLATFORM AND EXCERCISE METHOD

This is a continuation-in-part of application Ser. No. 07/894,181, filed on Jun. 5, 1992, now U.S. Pat. No. 5,314,395.

FIELD OF THE INVENTION

The present invention relates to flotation platforms engineered to permit aquatic based exercise routines for fitness or rehabilitation. More, particularly, the invention is a flotation platform exerciser suitable for use in a conventional bathtub and an exercise method directed to total body strength with focus on stomach and back muscles using the platform in a bathtub.

BACKGROUND OF THE INVENTION

Exercising is universally pursued for aerobic fitness, maintaining muscle tone, improving posture and rehabilitation. Swimming or other aquatic activity have long been favorites for such purposes mostly due to the low impact nature of such exercise. The muscle activities in swimming put little or no strain on limb joints while providing a significant cardiovascular workout.

There are, however, several drawbacks to swimming as a means for exercise. For many, swimming is difficult or impossible due to fear or no prior experience. Depending on the individual, swimming may involve too much strain or work. The present invention provides a unique solution to these problems by allowing a controlled set of exercise movements in a gravity free environment similar to swimming, yet in the safety and comfort of a bathub.

Additionally, the problem with exercise in general is that most people just do not have the time. Recently, the President's Council on Physical Fitness confirmed the time factor as being the number one reason why people do not exercise in the United States. Cost is another major factor affecting the decision to exercise or not, since health clubs and spas charge monthly fees far in excess of what the typical citizen can afford. Addressing both problems, the present disclosure claims a device which combines a daily task, namely bathing, with a virtually no-cost exercise, in the privacy of ones home.

Using a bathtub for exercise is confining, and the limited space provided by conventional bathrooms makes movement very difficult. Furthermore, the hard, slippery surfaces of the tub can contribute to injury. The presently disclosed device overcomes the above-identified obstacles.

SUMMARY OF THE INVENTION

The present invention is an aquatic exercise platform and a method of using the platform which allows one to enjoy a total body fitness, strength and toning workout focused on stomach and back muscles, within the soothing privacy of ones own bathtub.

The structure of the bathtub exercise platform comprises primarily, a flat upper float section and a flat lower float section connected by a flat hinge member. The entire platform is easily folded for storage when not in use. The floats are comprised of a floatation material such as closed cell foam, air-tight sacs or pouches or other material capable of providing buoyancy and comfortable cushion. Covering the platform is a water-resistant material such as a suitable synthetic well known to those skilled in the art, which is sewn, heat sealed or formed in situ over the floatation material.

The upper float is dimensioned to correspond to the shape of the back, and is relatively longer and narrower. The lower float section is somewhat wider than the upper float section. This relative dimensional configuration allows stability for the person sitting in the platform and allows strategic placement of snaps or fasteners connecting peripherals such as latex toning bands, for the arms to flex and extend without interference from the legs.

Thus, the apparatus provides support and buoyancy to a user during an exercise routine performed in a bathtub, with the upper flotation section configured and dimensioned to correspond to the shape of the user's back. A user's back is defined as extending from the head to the waist of the human user, and the upper flotation section is configured and dimensioned to provide sufficient buoyancy to support substanially all of the user's back at about the level of water in the bathtub.

The lower flotation section is configured and dimensioned to correspond to the shape of the user's seat. The user's seat is defined as being made up of an anatomical area covering the buttocks to the lower thigh region. The lower flotation section is configured and dimensioned to provide sufficient buoyancy to support substantially all of the seat at about the level of water in the bathtub. The flat hinge member has an upper portion hingedly connected to the upper flotation section, and a lower portion hingedly connected to the lower flotation section.

Since the conventional bathtub is a confined area of approximately sixty inches in length and twenty four inches wide, the two float sections are dimensioned accordingly. One skilled in the art can appreciate that a custom order for a platform for a bigger bathtub such as a jacuzzi would require bigger relative floats and hinge member. The converse is true for a smaller tub such as athletic whirlpools. Alternatively, if support for just the lower back region is required, smaller relative size, float sections are utilized.

Since the upper float section is designed to provide support for the back, in a conventional size, it conforms to the inclined end walls of a standard bathtub. The float sections are connected by the hinge member in a manner such that float section movements in the same or different relative directions are possible. Because the hinge basically remains on the floor of the tub, cushion floatation material is also put into the hinge member in order to make the lower back feel more comfortable than merely resting on the hard surface of the tub.

Snaps or fasteners are attached in significant locations throughout the platform to accommodate elastic toning bands for individual or simultaneous exercise movements. The toning bands are made of an elastic synthetic material or rubber such as the preferred embodiment elastic latex. Each preferred toning band is comprised of two loops in figure eight configuration which are adjustable by a hand grip placed between the two loops. Hand grips are also preferably placed at both ends of the loop and in the middle with a snap or fastener at one or both ends to correspond to the fasteners on the exercise platform. To adjust the elastic to the size or amount of resistance required, the middle hand grip is held with one hand and either the upper or lower ring of the elastic is pulled with the other hand.

The lower float also has attached foot straps which when utilized give the user a comfortable place to put the feet and act as resistance to specific muscle groups when moved through the water during certain exercise movements. The feet in the straps also act as an anchor to the lower float section as the elastic toning bands are stretched. The inserted feet are pushed in one direction while the elastic toning bands are pulled in the opposite direction for stability within the tub. Foot straps also give further maneuverability to the lower float during certain exercises.

In use, the bathtub exercise platform in conjunction with water in the tub, cushions the lower back, disks of the spinal column, and joints of the body in general, during exercise and provides a cushioned surface against the hard surfaces of a bathtub. The adjustable toning elastic bands along with the platform floats move against the natural resistance of water and the movement of the user's limbs and the torso on the platorm in combination therewith provide exercises adapted to the confined space of a bathtub.

Exercise movements using the platform should be performed slow and rhythmical in a bathtub kept at tepid water temperatures, and overwork of specific muscle groups should be avoided. Prior to exercising, all fasteners where elastics will be placed must be checked to make sure there is no wear that might cause the elastic to pull the fastener from the platform. Fifteen to twenty minutes of exercise three to four times per week will keep body muscles strong and taut. Each movement should be performed ten to twenty repetitions, then repeated between one to three times.

The method of using the bathtub exercise platform begins with filling a bathtub with a fluid, most conveniently warm water. A skilled artisan can readily observe that other fluids can be substituted for plain water. The platform is then placed in the bathtub and the user positions his/her seat on the lower flotation section, his/her back on the upper flotation section and the lower back area on the hinge member, such that sufficient buoyancy to support substanially all of the user's seat and back is provided at about the level of the fluid in the bathtub.

After positioning, the user mounts the platform whereby he/she is supported at a partially submerged surface position in the filled bathtub, facing upward such that the user is permitted to move from both an inclined and an upright position when performing an aquatic exercise of his/her choice.

In the preferred embodiment, the user grasps with hands, elastic toning bands attached to either or both the upper and lower flotation sections and performs the aquatic exercise of choice with extensions and flexions of the upper and lower extremities by alternatively stretching and releasing tension on the elastic toning bands. Also preferably, the user inserts his/her feet into the foot straps in the lower flotation section during an aquatic exercise of choice requiring such insertion and for anchor.

After a completed workout, the device is folded up by attaching upper float fasteners to lower float fasteners, and allowed to drip dry in the tub.

BRIEF DESCRIPTION OF THE DRAWINGS

The above system is more fully understood by referring to the associated figures of which.

DETAILED DESCRIPTION OF THE INVENTION

Figure 1:
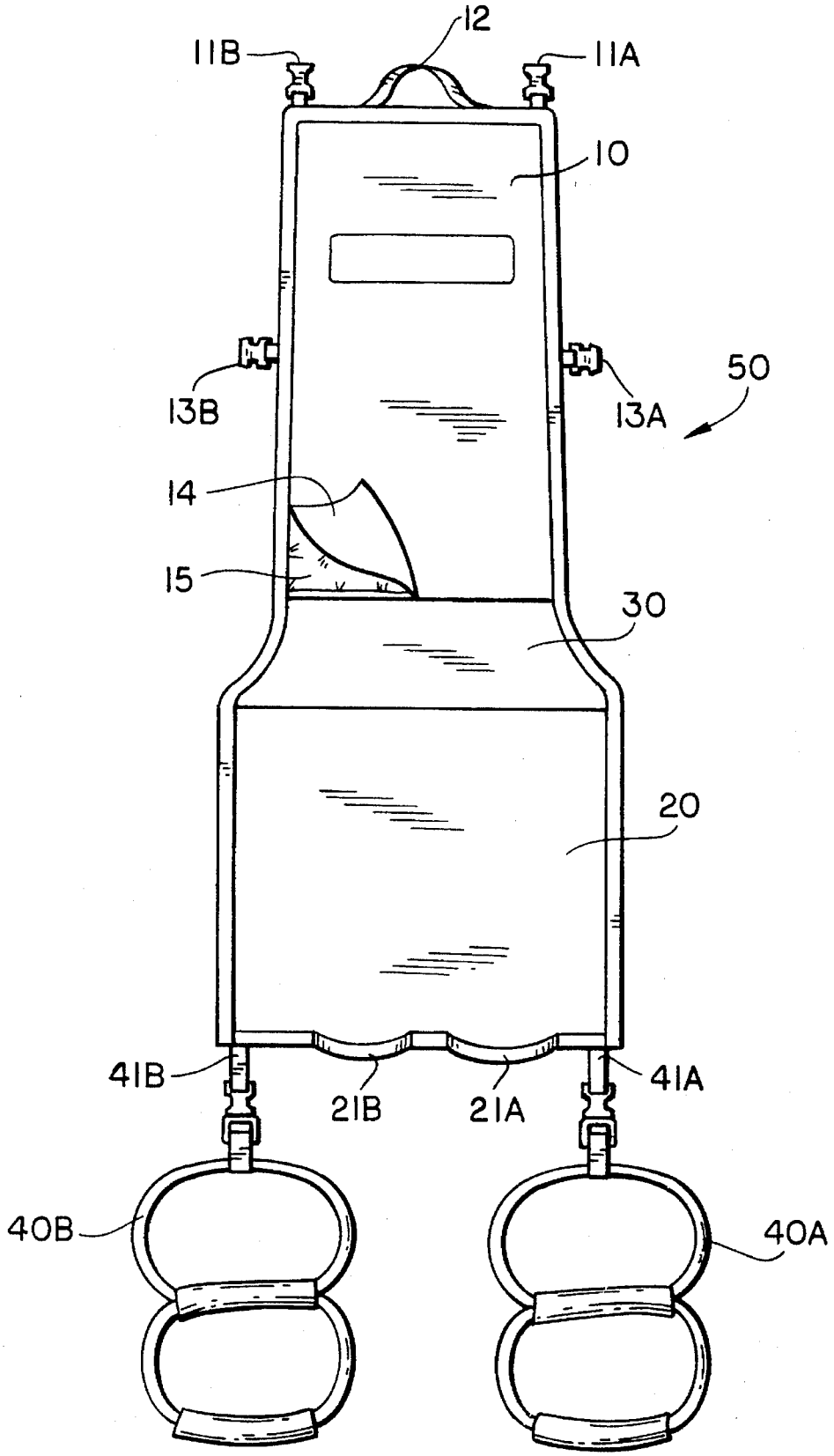
FIG. 1 provides a plan view showing the two main floats joined by a hinge member.

The exercise system focuses on compactness and adaptability to a standard five foot home bathtub. Turning to FIG. 1, the floatation platform, generally designated 50, is shown in plan view depicting the two main floats 10 and 20 joined by a hinge member 30. The three main structural components can also be called float sections, with the upper float section or upper float, 10, containing floatation material 15 (shown with flap 14 turned up), the lower float or "seat", 20, and interconnecting hinge float, 30. Seat 20 and hinge 30 both contain material similar to or identical with floatation material 15.

The floatation material in the float sections 10 and 20 and hinge member 30 give exercise platform 50 a buoyancy which gives support to the lower back and limb joints of the person sitting inside the device. Floatation material 15 can be closed cell foam, air or other inflatable gases within a sealed sac or a buoyant solid material, for providing the desired buoyancy and comfortable cushion for the user.

Attached at one end of platform 50 is an optional shoulder strap 12 for aid in storage and transportation. On either side of strap 12, are fasteners 11A and 11B for attachment of latex toning bands such bands 40A and 40B shown attached to fasteners 41A and 41B on lower float 20. The latex toning bands when attached to device 50 (see further details below) provide added resistance to specific muscle groups when used during exercise.

Attached to either sides of upper float 10 are fasteners 13A and 13B, also for attachment of latex toning bands such as or similar to bands 40A and 40B shown attached to fasteners 41A and 41B on lower float 20. Such latex toning bands attached to fasteners 13A and 13B provide the desired resistance for specific exercise routines using specific portions of platform 50.

Upper float 10 is connected to lower float 20 by flat hinge member 30. The connection between upper float 10 and hinge member 30 and the connection between lower float 20 and hinge member 30 are both, as the name of member 30 implies, a hinged attachment. Thus, the entire platform 50 is easily folded for storage when not in use.

Upper float 10 is relatively narrower than the somewhat wider lower float 20. This relative dimensional configuration allows stability for the person sitting in platform 50 in a bathtub, and allows versatile placement of interchangeable fasteners 11A, 11B, 13A, 13B, 41A and 41B for attaching latex toning bands such as 40A and 40B. The particular locations shown in FIG. 1 for these fasteners allow optimum flexion and extension of the limbs without interference from each other. However, those skilled in the art can readily see that other attachment locations are equally feasible depending on the desired type of exercise.

Upper float section 10 is connected to lower float section 20 by hinge member 30 such that float sections 10 and 20 are capable of orthogonal placement relative to each other. Thus, in a conventional bathtub, a portion of the upper float 10 can be inclined against one end wall of the tub, while the hinge member 30 basically remains on the floor of the tub to provide cushion for the lower back, and the lower float 20 can act as a seat parallel to or have a portion thereof on the floor of the tub.

FIG. 1 also shows lower float 20 having attached foot straps 21A and 21B which give the user of exercise platform 50 a versatile array of stomach and lower back exercises long with a location to place and hold the feet as anchor on lower float 20, as elastic toning bands 40A and 40B are stretched. For instance, the inserted feet are pushed in one direction while the elastic toning bands 40A and 40B are pulled in the opposite direction. This provides stability to device 50 in the tub during certain exercises.

Figure 2:
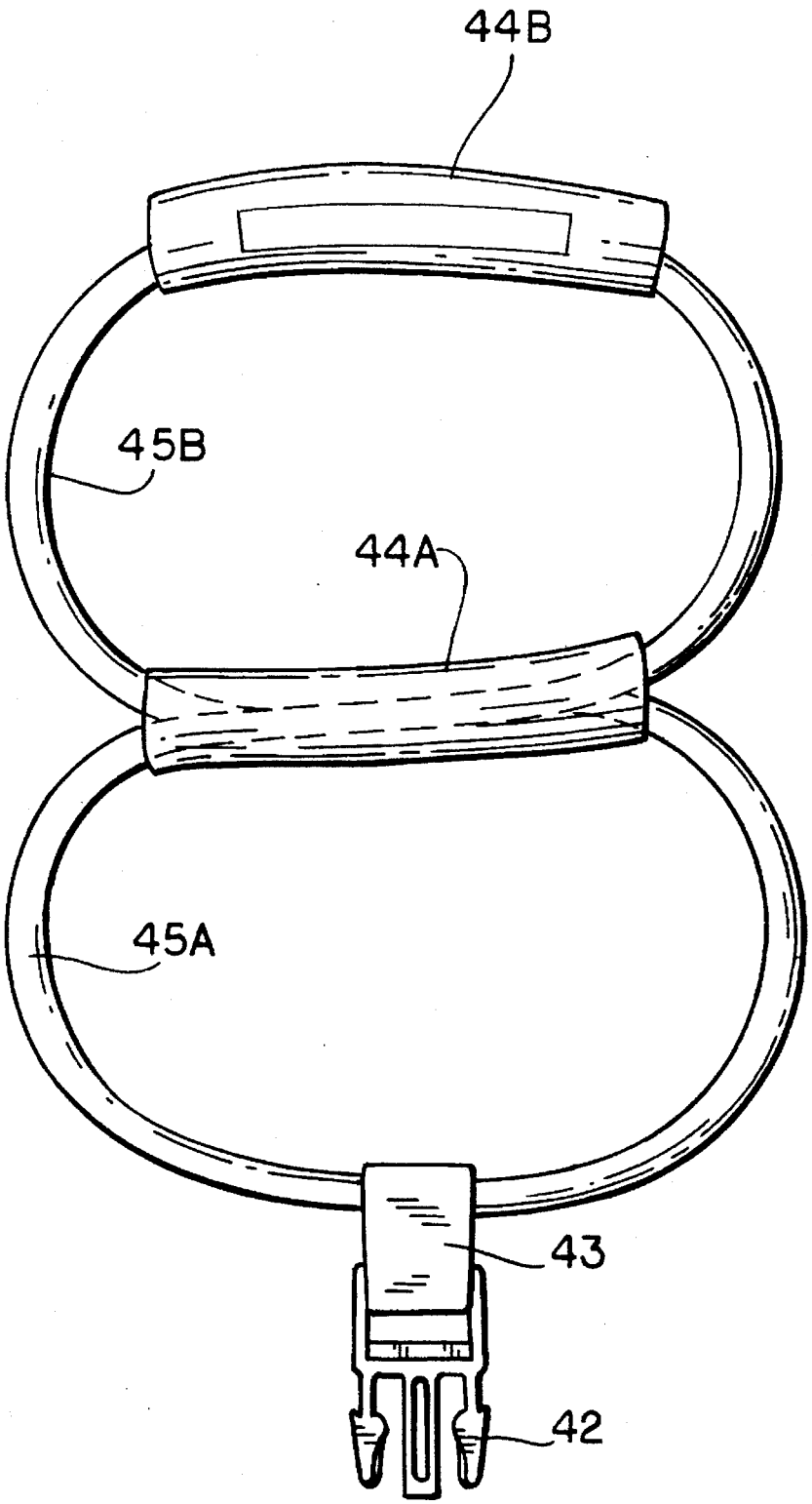
FIG. 2 depicts the preferred elastic bands.

FIG. 2 depicts an elastic toning band member generally designated 40. One or a plurality of bands such as band 40 can be attached in significant locations throughout the platform to accommodate individual or simultaneous exercise movements. Toning band member 40 is comprised of loops 45A and 45B which overlap each other in a figure eight configuration, and is made of an elastic synthetic material or rubber such as latex. Shown in FIG. 2 are the two loops joined, at the intersection of the figure eight overlap, by hand grip 44A. Loops 45A and 45B are adjustable by hand grip 44A. Hand grip 44B is also preferably placed on one end with hand grip 43 placed at the end joining fastener 42.

To adjust the size or amount of resistance required, hand grip 44A is held with one hand while either hand grip 43 or 44B is pulled with the other hand to a desired length or until the preferred resistance is obtained. Pulling to a shorter elastic length makes for greater resistance and vice versa. One skilled in the art can readily discern that different numbers of hand grips and loops may be utilized other than the combination specifically illustrated in FIG. 2.

Adjustable toning members such as toning band member 40 can be attached to either upper float 10 or lower float 20, and the particular location depends on the type or muscle group being exercised, for increasing resistance and performing combination exercise movements between upper or lower torso.

Depending on the size and depth of the tub along with the type of movements completed, exercises can be performed in the following five basic positions.

Figure 5A:
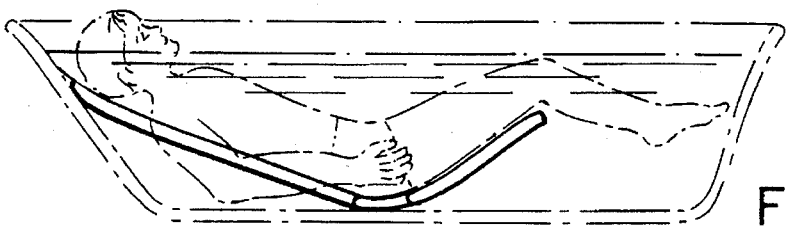
FIGS. 5A through 5E illustrate five basic exercise positions.
Figure 5B:
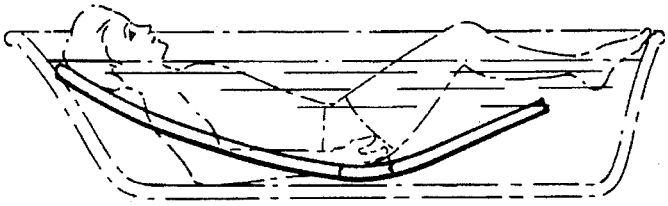
Figure 5C:
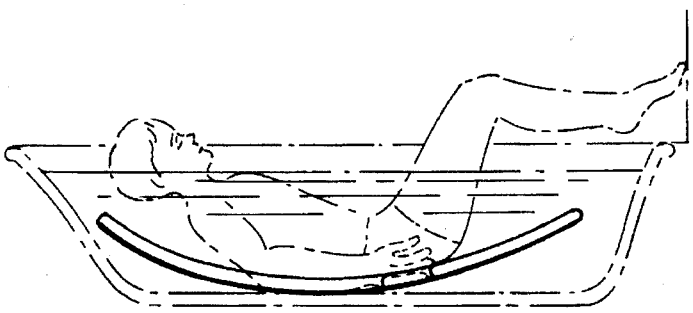
Figure 5D:
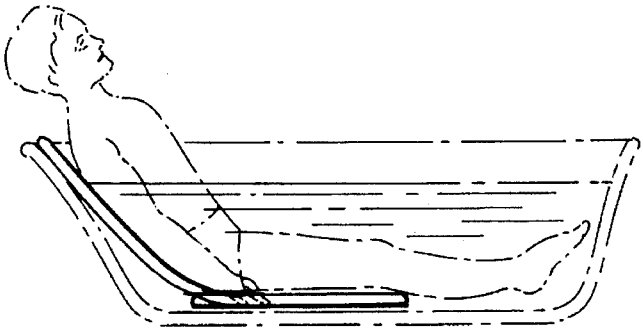
Figure 5E:
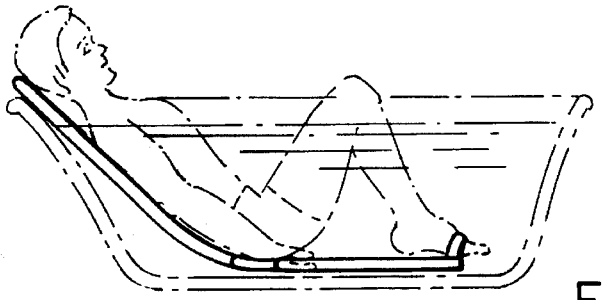

1. Fully reclined and extended in the supine position with the entire body (except for the facial portions for proper respiration) in the water such as shown in FIG. 5A.
2. Fully reclined with back partially submersed in water and the balls of the feet at the top of the rim on the end of the tub opposite as shown in FIG. 5B.
3. Fully reclined with feet above the tub on the wall with the user's back submerged in the water as shown in FIG. 5C.
4. Part reclined with upper torso against the back of the tub and legs completely submersed in water such as shown in FIG. 5D.
5. Part reclined with upper torso against the back of the tub, legs bent and feet in straps on lower float such as shown in FIG. 5D.

Figure 3A:
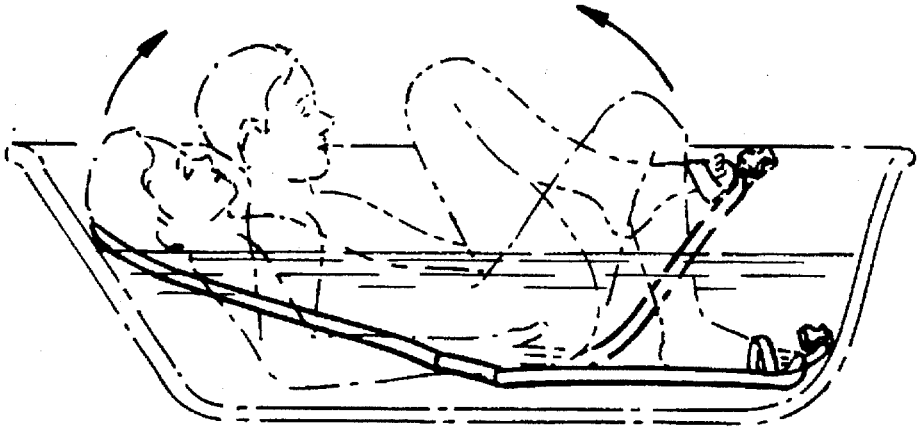
FIGS. 3A and 3B illustrate exercise routines using the present invention.
Figure 3B:
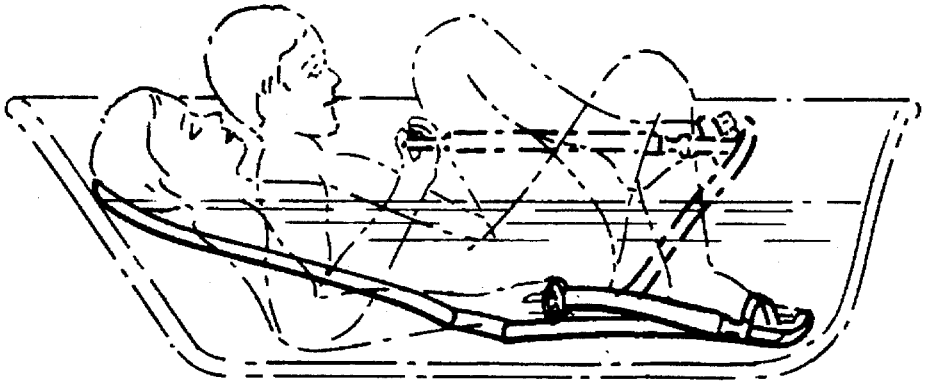

Additionally, FIG. 3A depicts the user performing leg raises and stomach crunches with the lower back and extremities supported by the natural buoyancy of the water and the exercise platform, while FIG. 3B shows a combination bicep curl with leg raises using latex toning bands held by the hands.

Figure 4A:
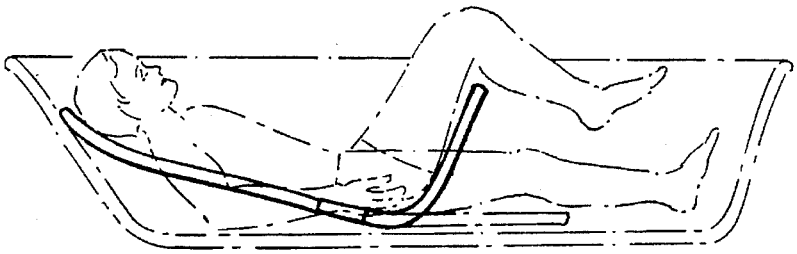
FIGS. 4A through 4D illustrate more exercise routines using the present invention.
Figure 4B:
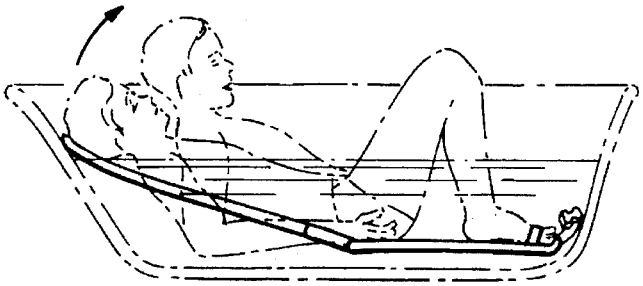
Figure 4C:
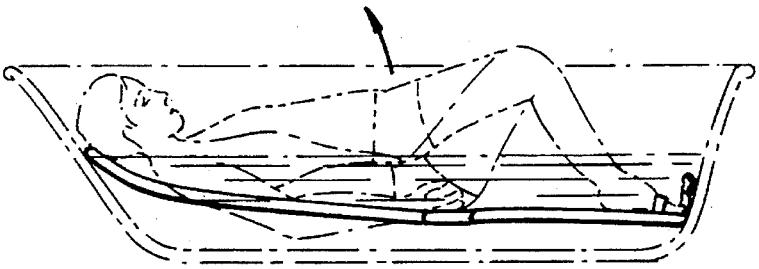
Figure 4D:
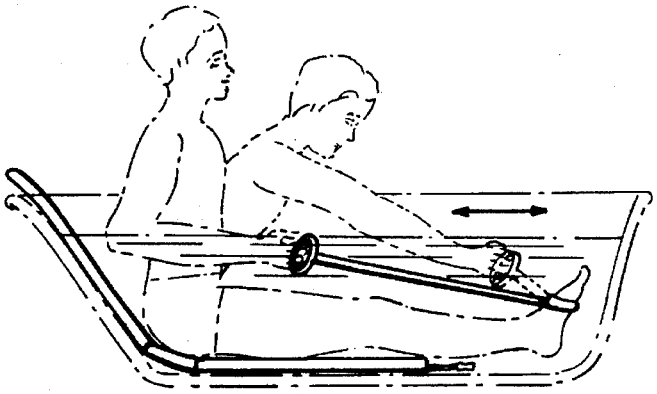

FIGS. 4A through and 4D show that upon mounting of the exercise platform, the said user is supported in a submerged surface position in the filled bathtub, facing upward with an anatomical area extending from the waist of said user to the buttocks of said user resting on the hinge member such that the user is permitted to move from both an inclined user position (FIG. 4C) or an upright user position (FIG. 4D) when performing an aquatic exercise of choice. Specifically, FIG. 4A depicts the user peforming leg and knee pushes, FIG. 4B shows the user doing sit-ups, FIG. 4C depicts the user performing pelvic arches and FIG. 4D shows a rowing exercise using the bathtub exercise platofrm.

The above-described arrangement is merely illustrative of the principles of the present invention. Numerous modifications and adaptations thereof will be readily apparent to those skilled in the art without departing from the spirit and scope of the present invention.

What is claimed is:

1. An apparatus for providing support and buoyancy to a user during an exercise routine performed in a bathtub, comprising:

an upper flotation section configured and dimensioned to correspond to the shape of the user's back as extending from the head to the waist of the user and having sufficient buoyancy to support substanially all of said user's back at about the level of the fluid in a filled bathtub;

a lower flotation section configured and dimensioned to correspond to the shape of the user's seat as extending from the buttocks to the lower thigh region of said user and having sufficient buoyancy to support substantially said seat at about said level of fluid in said bathtub; and a hinge member having an upper portion hingedly connected to said upper flotation section and said hinge member having a lower portion hingedly connected to said lower flotation section.

2. The apparatus of claim 1, wherein said flotation sections include a plurality of fasteners attached thereto.

3. The apparatus of claim 2, wherein said plurality of fasteners include at least one interchangeable fastener for attachment of at least one toning band such that said at least one toning band is connected to said apparatus.

4. The apparatus of claim 1, wherein said upper flotation section is designed to be inclined against one end wall of a conventional bathtub.

5. The apparatus of claim 1, wherein said hinge member is designed to be positioned on the floor of a conventional bathtub.

6. The apparatus of claim 1, wherein said lower flotation section is designed to have a portion thereof on the floor of a conventional bathtub.

7. The apparatus of claim 1, wherein said lower flotation section includes at least one foot strap for giving said user at least one location to place and hold at least one feet to act as resistance to specific muscle groups when moved through said fluid in said bathtub during certain exercise movements and act as an anchor on said lower float section.

8. The apparatus of claim 1, wherein said flotation sections include a plurality of toning bands attached thereto.

9. The apparatus of claim 8, wherein each of said toning bands is comprised of at least one elastic loop.

10. The apparatus of claim 9, wherein each of said toning bands is further comprised of at least one hand grip, said at least one elastic loop being adjustable in length and resistance by said at least one hand grip.

11. A foldable apparatus for providing support, resistance and buoyancy to a user during an exercise routine performed in a bathtub, comprising:

a flat upper flotation section configured and dimensioned to correspond to the shape of the user's back, said upper flotation section designed to be inclined against one end wall of said bathtub;

a flat lower flotation section configured and dimensioned to correspond to the shape of the user's seat, said lower flotation section designed to have a portion thereof on the floor of said bathtub, said lower flotation section having at least one foot strap for giving said user at least one location to place and hold at least one feet in anchor on said lower float section;

a hinge member having an upper portion hingedly connected to said upper flotation section and a lower portion hingedly connected to said lower flotation section, said hinge member designed to be positioned on the floor of said bathtub; and said upper and lower flotation sections having attached thereto, a plurality of interchangeable fasteners for attachment of a plurality of toning bands, wherein each of said toning bands is comprised of at least one elastic loop and at least one hand grip, said at least one loop being adjustable by said at least one hand grip.

12. A method of aquatic exercise performed by a user in a bathtub, comprising the steps of:

a) placing in said bathtub filled with a fluid, a device having an upper flotation section, a lower flotation section with at least one foot strap attached thereto, and a hinge member hingedly connecting said upper flotation section to said lower flotation section, with said upper and lower flotation sections having at least one elastic toning band attached thereto;

b) positioning the user's seat, comprised of an anatomical area extending from the buttocks to the lower thigh region of said user, on said lower flotation section such that sufficient buoyancy to support substanially all of said user's seat is provided at about the level of said fluid in said bathtub;

c) positioning the user's back, comprised of an anatomical area extending from the head to the waist of the user, on said upper flotation section such that sufficient buoyancy to support substanially all of said user's back is provided at about said level of said fluid in said bathtub; and d) mounting said device after said positionings defined in steps (b) and (c), whereby said user is supported at a partially submerged surface position in said filled bathtub, facing upward with the user's lower back resting on said hinge member, such that said user is permitted to move from both an inclined and an upright user position when performing an aquatic exercise.

13. The method of claim 12, further comprising the step of grasping said at least one elastic toning band attached to said upper and lower flotation sections by at least one hand of said user and performing said aquatic exercise by extending or flexing the upper and lower extremities.

14. The method of claim 13, further comprising the step of inserting at least one foot into said at least one strap in said lower flotation section and performing said aquatic exercise by using said at least one foot in said at least one strap as resistance to specific muscle groups when moved through said fluid during certain exercise movements, and as at least one anchor.

15. The method of claim 14, wherein said aquatic exercise includes a user position selected from the group consisting of (a) fully reclined and extended in the supine position with substantially all of the user's body in said fluid, (b) fully reclined with said back partially submersed in said fluid with the balls of the feet of said user at the top of the rim of said bathtub, (c) fully reclined with the feet of said user placed on the wall adjacent an end of said bathtub with said user's back submerged in said fluid, (d) part reclined with the upper torso of said user placed against the back of said bathtub with the lower extremities of said user completely submersed in said fluid, and (e) part reclined with the upper torso of said user placed against the back of said bathtub, with the lower extremities of said user bent and at least one feet of said user in said at least one strap in said lower flotation section.

* * * * *